US010924865B2

(12) United States Patent
Song et al.

(10) Patent No.: US 10,924,865 B2
(45) Date of Patent: Feb. 16, 2021

(54) SPEAKER

(71) Applicant: AAC Technologies Pte. Ltd., Singapore (SG)

(72) Inventors: Wei Song, Shenzhen (CN); Shuwen Wu, Shenzhen (CN); Fan Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/526,940

(22) Filed: Jul. 30, 2019

(65) Prior Publication Data

US 2020/0045466 A1 Feb. 6, 2020

(30) Foreign Application Priority Data

Aug. 3, 2018 (CN) ..... 2018 2 1251167 U

(51) Int. Cl.
*H04R 9/06* (2006.01)
*H04R 9/02* (2006.01)
*H04R 7/20* (2006.01)

(52) U.S. Cl.
CPC ..... *H04R 9/06* (2013.01); *H04R 7/20* (2013.01); *H04R 9/025* (2013.01); *H04R 2307/207* (2013.01); *H04R 2400/11* (2013.01); *H04R 2499/11* (2013.01)

(58) Field of Classification Search
CPC . H04R 7/18; H04R 7/127; H04R 9/06; H04R 2307/025; H04R 2307/027; H04R 9/025; H01F 7/081; H01F 7/126
USPC ..... 381/398, 400
See application file for complete search history.

(56) References Cited

U.S. PATENT DOCUMENTS

2011/0075880 A1* 3/2011 Kamimura ..... H04R 9/10 381/413
2013/0016874 A1* 1/2013 Huang ..... H04R 9/043 381/433
2013/0156237 A1* 6/2013 Kim ..... H04R 31/00 381/191
2014/0376766 A1* 12/2014 Chen ..... H04R 1/06 381/400
2018/0035213 A1* 2/2018 Shan ..... H04R 1/22
2018/0302724 A1* 10/2018 Li ..... H04R 7/12

* cited by examiner

*Primary Examiner* — Sean H Nguyen
(74) *Attorney, Agent, or Firm* — W&G Law Group LLP

(57) ABSTRACT

The present disclosure provides a speaker including a frame having an accommodating space, a vibration system and a magnetic circuit system that are accommodated in the accommodating space. The vibration system includes a first diaphragm configured to vibrate and produce sound, a voice coil located below the first diaphragm and configured to drive the first diaphragm to vibrate and produce sound, a flexible circuit board electrically connected to the voice coil and elastically supporting the voice coil, and a second diaphragm fixed to the flexible circuit board. The flexible circuit board includes a first fixing portion connected to the voice coil, a second fixing portion disposed opposite to and separately from the first fixing portion, and an elastic arm connecting the first fixing portion and the second fixing portion. An orthogonal projection of the elastic arm toward the second diaphragm is partially located within a range of the second diaphragm.

6 Claims, 4 Drawing Sheets

SPEAKER

TECHNICAL FIELD

The present disclosure relates to electroacoustic conversion technology, and in particular, to a speaker.

BACKGROUND

In recent years, with a rapid development of mobile communication technologies, customers have more access to mobile communication devices having a voice function, for example, portable phones, handheld game machines, and laptop computers. Quality of a designed speaker as a voice playing device directly influences a voice performance of products such as mobile communication devices. To meet market demands for thin speakers having higher sound quality, higher requirements are imposed on design of flexible circuit boards of speakers.

In related technologies, a flexible circuit board of a speaker is fixedly connected to a second diaphragm, and is configured to connect a voice coil and an external circuit. The flexible circuit board includes an elastic arm suspended in an accommodating space of the speaker, and the elastic arm is completely located below a first diaphragm. Thus, a length of the elastic arm is limited, thereby limiting an upper limit of elasticity of the flexible circuit board and hindering improvement of acoustic performance of the speaker.

Therefore, it is necessary to provide a new speaker to address the foregoing limitations.

BRIEF DESCRIPTION OF THE DRAWINGS

To clearly illustrate technical solutions in embodiments of the present disclosure, drawings used in description of the embodiments are briefly described below. Obviously, the drawings in the following description are only some embodiments of the present disclosure, and other drawings can be obtained by those of ordinary skill in the art according to these drawings without creative efforts.

DETAILED DESCRIPTION

Technical solutions in embodiments of the present disclosure are clearly and completely described with reference to the drawings in the embodiments of the present disclosure. Obviously, the embodiments described are only some embodiments rather than all embodiments of the present disclosure. All other embodiments obtained by those of ordinary skill in the art based on the embodiments of the present disclosure without creative efforts shall fall within the protection scope of the present disclosure.

Figure 1:
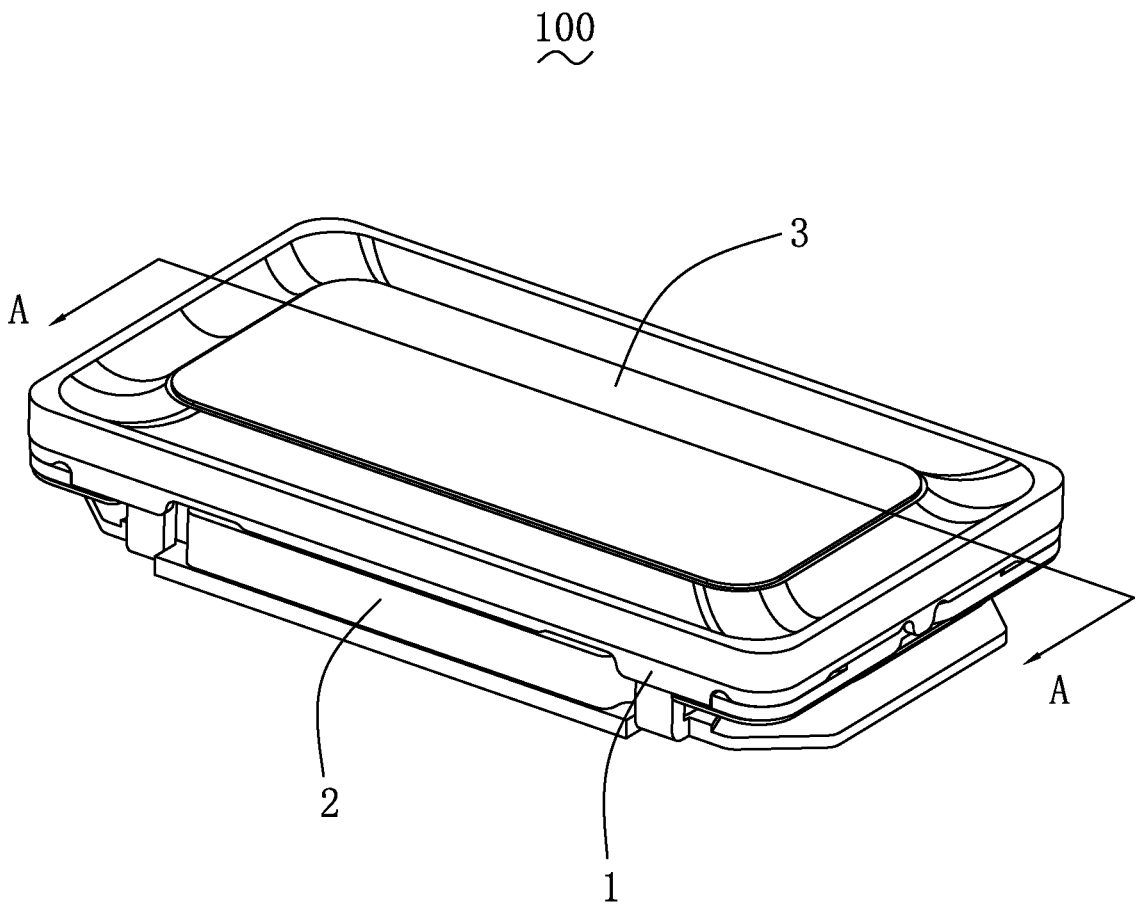
FIG. 1 is a schematic three-dimensional structural view of a speaker in the present disclosure.
Figure 3:
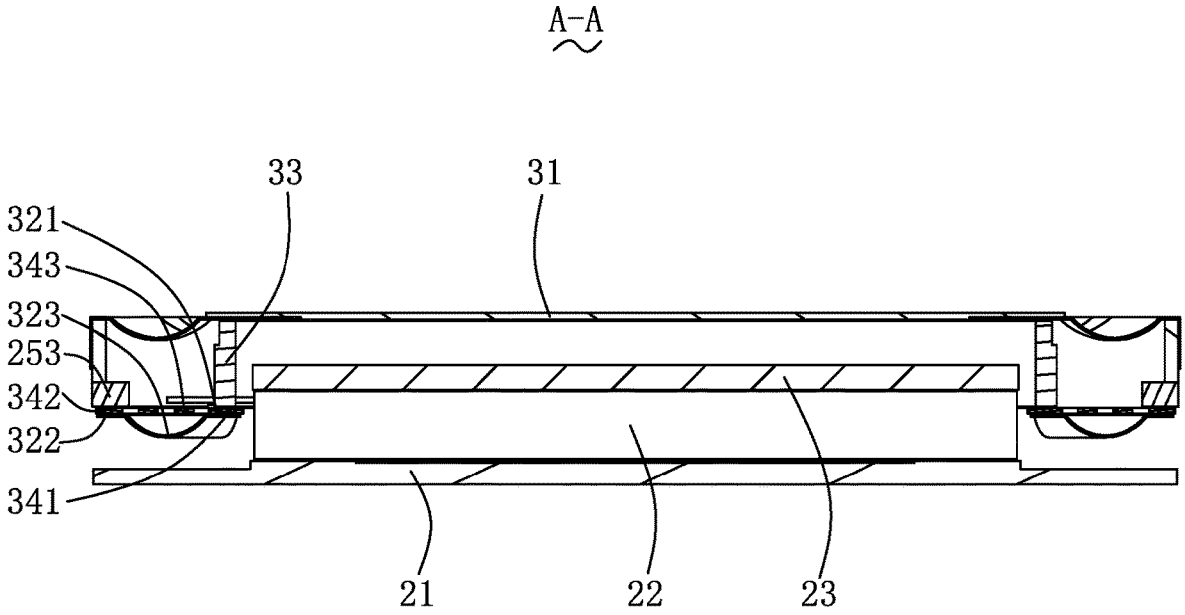
FIG. 3 is a sectional view of the speaker along an A-A line shown in FIG. 1.

Referring to FIG. 1 and FIG. 3, the present disclosure provides a speaker 100. The speaker 100 includes a frame 1 having an accommodating space, a magnetic circuit system 2 and a vibration system 3 that are accommodated in the accommodating space.

The magnetic circuit system 2 is configured to drive the vibration system 3 to vibrate and produce sound. Specifically, the magnetic circuit system 2 includes a yoke 21 fixedly connected to the frame 1, a main magnetic steel 22 assembled to the middle of the yoke 21, a main pole core 23 attached to a surface of the main magnetic steel 22, an auxiliary magnetic steel 24 disposed around the main magnetic steel 22, and an auxiliary pole core 25 attached to the auxiliary magnetic steel 24. The main magnetic steel 22 and the auxiliary magnetic steel 24 are separated from each other to form a magnetic gap. The pole core 23 and the auxiliary pole core 25 are made of magnetic conductive materials and act as magnetic conductors.

The auxiliary pole core 25 is fixedly connected to the frame 1, and includes a body portion 251 connected to the auxiliary magnetic steel 24, an extended portion 252 extending from two ends of the body portion 251 toward a direction away from the body portion 251, and a step portion 253 bent and extending from one end of the extended portion 252 away from the body portion 251 toward the auxiliary magnetic steel 24. The step portion 253 and the extended portion 252 form a stepped structure together.

The vibration system 3 is configured to vibrate and produce sound. Specifically, the vibration system 3 includes a first diaphragm 31 configured to vibrate and produce sound, a second diaphragm 32 disposed opposite to the first diaphragm 31, a voice coil 33 located below the first diaphragm 31 and configured to drive the first diaphragm 31 to vibrate and produce sound, and a flexible circuit board 34 electrically connected to the voice coil 33 and elastically supporting the voice coil 33. The flexible circuit board 34 is sandwiched between the second diaphragm 32 and the auxiliary pole core 25, is configured to electrically connect the voice coil 33 and an external circuit, and further configured to enhance vibration of the first diaphragm 31 and prevent polarization of the first diaphragm 31, so as to improve acoustic performance of the speaker 100.

The second diaphragm 32 includes a fixing portion 321, a connecting portion 322 disposed separately from the fixing portion 321, and a folded ring portion 323 connecting the fixing portion 321 and the connecting portion 322.

Figure 2:
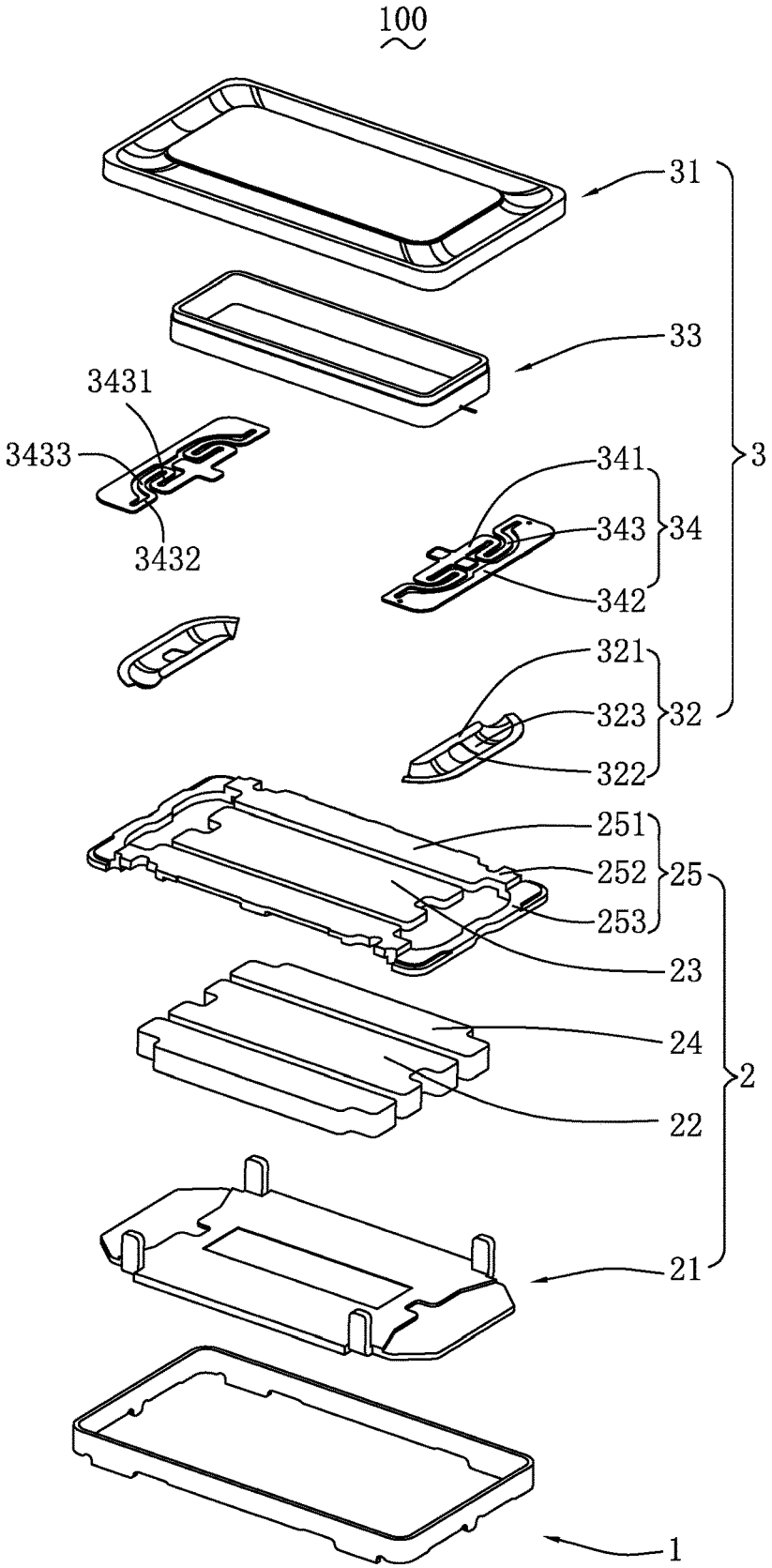
FIG. 2 is a structural exploded view of the speaker shown in FIG. 1.
Figure 4A:
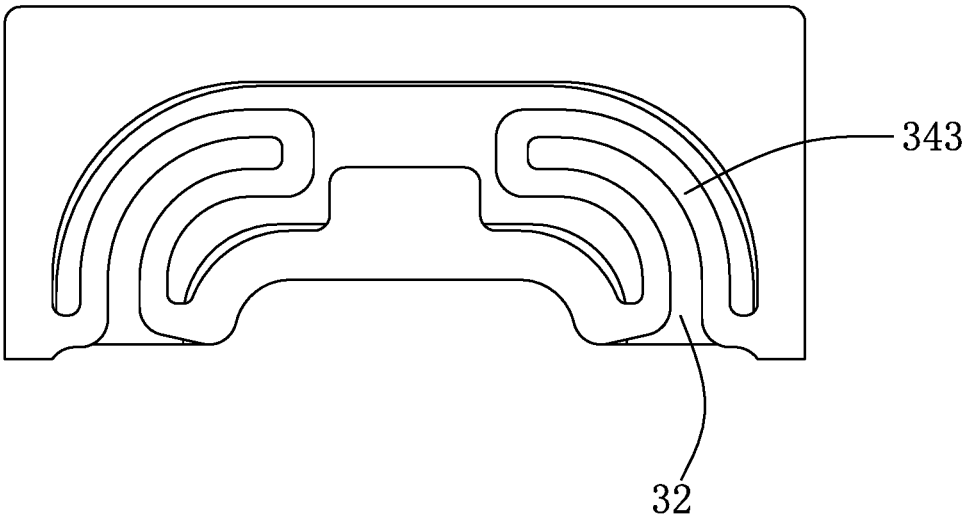
FIG. 4A is a front view of an assembled structure of a second diaphragm and a flexible circuit board of a speaker in related technologies.
Figure 4B:
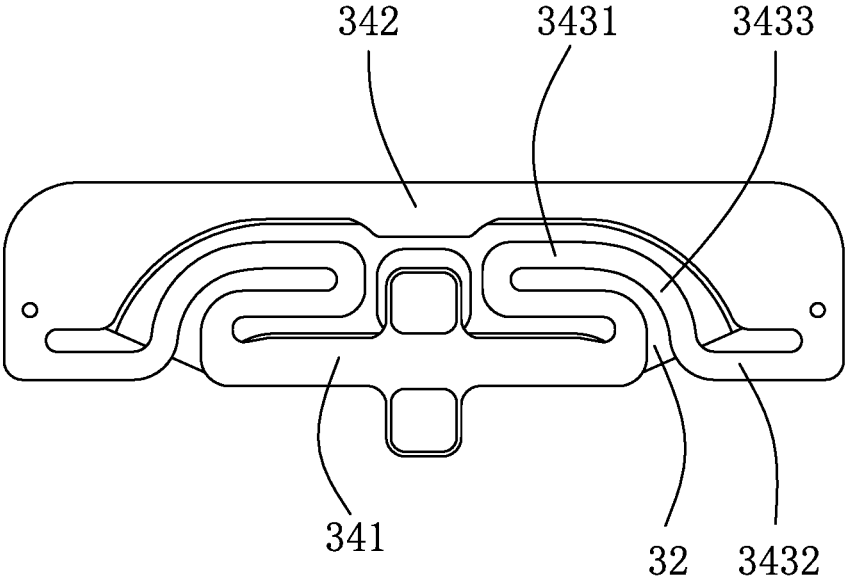
FIG. 4B is a front view of an assembled structure of a second diaphragm and a flexible circuit board of a speaker in the present disclosure.

Referring to FIG. 2 and FIG. 4B, the flexible circuit board 34 includes a first fixing portion 341 connected to the voice coil 33, a second fixing portion 342 disposed opposite to and separately from the first fixing portion 341, and an elastic arm 343 connecting the first fixing portion 341 and the second fixing portion 342. An orthogonal projection of the elastic arm 343 toward the second diaphragm 32 is partially located within a range of the second diaphragm 32.

The fixing portion 321 is fixedly connected to the first fixing portion 341. The connecting portion 322 is fixedly connected to the second fixing portion 342. The folded ring portion 323 and the elastic arm 343 are disposed separately from each other. Specifically, the first fixing portion 341 is sandwiched between the voice coil 33 and the fixing portion 321, and the second fixing portion 342 is sandwiched between the connecting portion 322 and the step portion 253.

Further, the elastic arm 343 includes a first torque arm 3431 reciprocally bent from two ends of the first fixing portion 341 toward the second fixing portion 342, a second torque arm 3432 bent and extending from two ends of the second fixing portion 342 toward the first fixing portion 341, and a third torque arm 3433 connecting the first torque arm 3431 and the second torque arm 3432 and bent in an arc shape. The first torque arm 3431, the second torque arm 3432, and the third torque arm 3433 are integrally formed, and form a closed structure together with the first fixing portion 341 and the second fixing portion 342. The second torque arm 3432 is disposed in parallel to the extended portion 252.

Orthogonal projections of the first torque arm 3431 and the third torque arm 3433 toward the second diaphragm 32 are completely located within the range of the second diaphragm 32, and an orthogonal projection of the second torque arm 3432 toward the second diaphragm 32 is located outside the range of the second diaphragm 32. Specifically, the elastic arm 343 is partially located below the second diaphragm 32, and partially extends away from the second diaphragm 32.

Referring to FIG. 4A, in related technologies, the elastic arm 343 is completely located below the second diaphragm 32. Thus, a length of the elastic arm 343 is limited, thereby limiting an upper limit of elasticity of the flexible circuit board 34 and hindering improvement of the acoustic performance of the speaker.

Referring to FIG. 4B, with respect to the speaker 100 in the present disclosure, the elastic arm 343 is partially located below the second diaphragm 32, and partially extends away from the second diaphragm 32. Thus, the length of the elastic arm 343 is increased, thereby enhancing the elasticity of the flexible circuit board 34, improving the acoustic performance of the speaker 100, and providing higher reliability.

Compared with the related technology, with respect to the speaker 100 in the present disclosure, the elastic arm 343 of the flexible circuit board 34 is partially located below the second diaphragm 32, and the remaining part extends toward a direction away from the second diaphragm 32. Thus, the length of the elastic arm 343 is increased, thereby enhancing the elasticity of the flexible circuit board 34, improving the acoustic performance of the speaker 100, and providing higher reliability.

The above descriptions are merely embodiments of the present disclosure, and it should be noted that those of ordinary skill in the art can make improvements without departing from the inventive concept of the present disclosure, and all such improvements shall fall within the protection scope of the present disclosure.

What is claimed is:

1. A speaker, comprising a frame having an accommodating space, a vibration system and a magnetic circuit system that are accommodated in the accommodating space, wherein the vibration system comprises a first diaphragm configured to vibrate and produce sound, a voice coil located below the first diaphragm and configured to drive the first diaphragm to vibrate and produce sound, a flexible circuit board electrically connected to the voice coil and elastically supporting the voice coil, and a second diaphragm fixed to the flexible circuit board, wherein the flexible circuit board comprises a first fixing portion connected to the voice coil, a second fixing portion disposed opposite to and separately from the first fixing portion and connected to the second diaphragm, and an elastic arm connecting the first fixing portion and the second fixing portion, wherein an orthogonal projection of the elastic arm toward the second diaphragm is partially located within a range of the second diaphragm, wherein the elastic arm comprises a first torque arm reciprocally bent from two ends of the first fixing portion toward the second fixing portion, a second torque arm bent and extending from two ends of the second fixing portion toward the first fixing portion, and a third torque arm connecting the first torque arm and the second torque arm and bent in an arc shape, wherein orthogonal projections of the first torque arm and the third torque arm toward the second diaphragm are completely located within the range of the second diaphragm and an orthogonal projection of the second torque arm toward the second diaphragm is located outside the range of the second diaphragm.

2. The speaker according to claim 1, wherein the first torque arm, the second torque arm, and the third torque arm are integrally formed, and form a closed structure together with the first fixing portion and the second fixing portion.

3. The speaker according to claim 1, wherein the second diaphragm comprises a fixing portion fixedly connected to the first fixing portion, a connecting portion disposed separately from the fixing portion and connected to the second fixing portion, and a folded ring portion connecting the fixing portion and the connecting portion, wherein the elastic arm and the folded ring portion are disposed separately from each other.

4. The speaker according to claim 3, wherein the magnetic circuit system comprises a yoke fixedly connected to the frame, a main magnetic steel assembled to the yoke, a main pole core attached to a surface of the main magnetic steel, an auxiliary magnetic steel disposed around the main magnetic steel, and an auxiliary pole core attached to the auxiliary magnetic steel, wherein the main magnetic steel and the auxiliary magnetic steel are separated from each other to form a magnetic gap, and the voice coil is suspended in the magnetic gap.

5. The speaker according to claim 4, wherein the auxiliary pole core is fixedly connected to the frame, the auxiliary pole core comprises a body portion connected to the auxiliary magnetic steel, an extended portion extending from two ends of the body portion toward a direction away from the body portion, and a step portion bent and extending from one end of the extended portion away from the body portion toward the auxiliary magnetic steel, wherein the second torque arm is disposed in parallel to and separately from the extended portion, and the second fixing portion is fixedly connected to the step portion.

6. The speaker according to claim 5, wherein the first fixing portion is sandwiched between the fixing portion and the voice coil, and the second fixing portion is sandwiched between the connecting portion and the step portion.

* * * * *